United States Patent [19]

Fishaber et al.

[11] 3,992,234

[45] Nov. 16, 1976

[54] POWDERLESS ETCHING METHOD FOR MAGNESIUM PRINTING PLATES

[75] Inventors: Marvin H. Fishaber, Saginaw; Philip C. White, Midland, both of Mich.

[73] Assignee: The Dow Chemical Company, Midland, Mich.

[22] Filed: May 12, 1975

[21] Appl. No.: 576,500

Related U.S. Application Data

[62] Division of Ser. No. 415,052, Nov. 12, 1973, Pat. No. 3,922,229.

[52] U.S. Cl. ..... 156/13; 156/14; 156/18; 252/79.2; 252/79.4

[51] Int. Cl.[2] ..... B41C 1/02

[58] Field of Search ..... 156/14, 18, 13, 14; 252/79.4

[56] References Cited

UNITED STATES PATENTS

| | | | |
|---|---|---|---|
| 3,725,158 | 4/1973 | Messerschmidt et al. | 156/14 |
| 3,730,899 | 5/1973 | Messerschmidt et al. | 156/14 |
| 3,935,118 | 1/1976 | Czier et al. | 156/14 |

*Primary Examiner*—William A. Powell
*Assistant Examiner*—Jerome W. Massie
*Attorney, Agent, or Firm*—Glenn H. Korfhage

[57] ABSTRACT

An etching bath for printing plates of magnesium or alloys thereof comprising: aqueous nitric acid; a sulfated fatty acid ester; a first saturated or olefinically unsaturated carboxylic acid which comprises a hydroxy-unsubstituted monocarboxylic acid of from 2 to 6 carbon atoms, or a polycarboxylic or hydroxy substituted monocarboxylic acid of from 2 to 8 carbon atoms; a polyhydric alcohol of from 2 to 10 carbon atoms or an ether derivative thereof; a second saturated or olefinically unsaturated carboxylic acid which comprises at least one hydroxy-unsubstituted monocarboxylic acid of from 8 to 24 carbon atoms; and an alkylarylsulfonate. A concentrated additive comprising all of the foregoing bath ingredients except the aqueous nitric acid, to which water and nitric acid are added to provide a powderless etching bath. A method for etching printing plates of magnesium or alloys thereof using the foregoing bath formulation.

6 Claims, No Drawings

POWDERLESS ETCHING METHOD FOR MAGNESIUM PRINTING PLATES

CROSS REFERENCE TO RELATED APPLICATION

This is a division of application Ser. No. 415,052 filed Nov. 12, 1973, now U.S. Pat. No. 3,922,229, issued Nov. 25, 1975.

BACKGROUND OF THE INVENTION

This invention relates to a novel powderless etching bath composition for etching plates of magnesium or alloys thereof, an additive for use with nitric acid and water to form an etching bath formulation, and a method for etching plates of magnesium or magnesium alloy. (Hereinafter the term "magnesium" includes alloys thereof containing at least about 70 weight percent magnesium.)

In the preparation of metal printing plates, a plate of an acid soluble metal such as magnesium is coated in the plate making plant with a light sensitive coating or "enamel" which is applied to the metal surface which is usually flat but may be curved. Alternatively, photoresist coated ("presensitized") flat plates are now available commercially which enable one practicing the art to avoid the time consuming coating step immediately prior to exposing the plate. The coated surface is exposed to light through a negative having an image thereon so as to cause or initiate cross-linking in the polymeric coating material to produce a corresponding image in the coating. The exposed coated surface is developed, and a pattern of an acid resistant coating is thereby formed on the plate in the form of the image produced by the exposure and is known as the "photoresist" image, or simply "resist" image. Depending on the type of coating employed, an additional heating step may be required to further harden and affix the acid resistant coating to the metal surface. Subsequently, the image bearing surface of the plate is etched by contacting it with an acid, thereby dissolving metal from those portions of the plate which are not protected by the photoresist. In the absence of any means of sidewall protection, the acid also tends to etch laterally and undercut the resist as the etching proceeds, thus distorting or destroying the image.

Originally, this undercutting was controlled by the time consuming and difficult method known as "powdering" of the plate, whereby the sides of the relief were manually covered with an acid resistant powder several times during the etching process.

Approximately 20 years ago, powderless etching baths usable in etching machines were introduced as taught in U.S. Pat. Nos. 2,640,763–'767 which were so formulated as to eliminate the need for powdering. Though at the time they represented a revolutionary advance over the prior art, these early formulations were deficient in many respects.

The art of powderless etching has continued to be refined and advanced in recent years, and is now a well-known, widely practiced technique. Subsequent formulations, such as that taught in U.S. Pat. No. 2,979,387, for example, employed large quantities of a water immiscible organic liquid which is substantially unreactive with the aqueous acid bath. However, the modern formulations employing such organic liquid are undesirable in that they pose a substantial waste disposal problem. Since the water immiscible organic liquid, which is generally a petroleum solvent, is a serious pollutant, it is ecologically unsound to dispose of the used bath by merely draining it in a conventional drain. Very recently, a series of five patents have issued (U.S. Pat. Nos. 3,725,158; 3,725,159; 3,728,180; 3,730,899; and 3,736.197), which teach new formulations whereby the water immiscible organic liquid can be eliminated or at least reduced. The etching bath of each of these recent patents employs a sulfonated carboxylic acid.

It is an important object of this invention to provided a novel bath for etching at high speeds without sacrificing the quality of the etch produced, shaped articles of magnesium or magnesium alloys such as photoengraving plates.

It is another object of this invention to provide an improved, high speed etching bath having a markedly improved filming capacity for better side wall protection.

Other objectives of this invention include providing a novel high speed etching bath capable of producing desired depths of etch in all kinds of image areas of combination plates, including solid areas, half tones, and large open areas, providing a high speed etching bath capable of forming a stable protective film to prevent or retard lateral etching and chipping of relief side walls; and providing a high speed etching bath which eliminates or minimizes the so-called "pimpling" in large open areas.

Two additional objectives of this invention are to provide a novel additive for used in connection with water and nitric acid in making up etching baths and to provide a novel method for high speed etching.

Finally, it is a primary objective to accomplish all of the above as well as arriving at a stable composition for enhanced bath life without employing an unreactive water immiscible organic liquid.

Other and additional objects will become apparent from a consideration of this entire specification, including the claims.

SUMMARY OF THE INVENTION

It has been discovered that by employing an etching bath formulation described as follows, each of the above objectives is accomplished. The formulation comprises, per liter of bath:

a. from about 70 grams to about 360 grams of 42° Baume nitric acid;

b. from about 0.25 gram to about 5 grams of a sulfated fatty acid ester wherein the acid moiety contains from 10 to 24 carbon atoms and the alcohol moiety contains from 1 to 12 carbon atoms;

c. from about 0.25 gram to about 6 grams of a first saturated or olefinically unsaturated carboxylic acid which comprises a hydroxy-unsubstituted monocarboxylic acid of from 2 to 6 carbon atoms, or a polycarboxylic or hydroxy-substituted monocarboxylic acid of from 2 to 8 carbon atoms;

d. from about 2 grams to about 25 grams of a polyhydric alcohol of from 2 to 10 carbon atoms or an ether derivative thereof;

e. from about 2 grams to about 15 grams of a second saturated or olefinically unsaturated carboxylic acid which comprises at least one monobasic fatty acid having from 8 to 24 carbon atoms;

f. from about 0.25 gram to about 4 grams of an alkylarylsulfonate selected from the group consisting of the alkylbenzenesulfonates wherein the alkyl portion contains from 8 to 18 carbon atoms and the alkylnapthalenesulfonates wherein the alkyl portion contains from 3 to 18 carbon atoms, as exemplified in the formula $RA—SO_3X$ wherein R is an alkyl radical having from 3 to 18 carbon atoms inclusive, A is an aromatic nucleus, such as, for example, phenyl or naphthyl, and X is hydrogen or a salt forming cation, e.g., an alkali metal or alkaline earth metal; and g. water to volume.

Since the quantities of nitric acid and water far exceed that of the other components of the bath, it is commercially advantageous to mix in advance the remaining components, along with a quantity of water sufficient to maintain the mix in a single phase and to yield a desired predetermined dilution level, and to ship and/or store the resulting mixture separately for subsequent use as an additive with an aqueous solution of nitric acid. Accordingly, such an additive is within the scope of this invention apart from the bath itself.

Also within the scope of this invention is a method for etching plates of magnesium employing a bath such as is described herein, maintaining the bath at a substantially uniform preselected temperature and contacting the plate surface to be etched with the bath.

FURTHER DESCRIPTION OF THE INVENTION

In the practice of this invention, use of a polyvinyl cinnamate based photoresist is much preferred. While a polyvinyl alcohol based photoresist which has been very thoroughly hardened is satisfactory for very shallow depths of etch, it has been discovered that such a photoresist often fails in the etching bath of this invention before a commercially acceptable depth of etch has been attained. Distorted side walls also often result when plates having a polyvinyl alcohol based photoresist are contacted with a bath as contemplated herein.

Nitric Acid

The nitric acid component of the bath is well-known. Generally, the rate of etch increases with increasing concentration of nitric acid. An insufficient concentration will result in a slower rate of etch. An excess of nitric acid, however, is undesirable for several reasons. Since the etching reaction is exothermic, more heat is generated per unit area in relatively open areas of the plate than in those areas covered with the photoresist in more dense image patterns, thus causing substantial temperature differences between the open and the image containing portions of the plate. Moreover, the gradation is augmented as the etching continues since the higher temperature of the open areas of the plate in turn results in a more rapid rate of etch. As a consequence, an excess of nitric acid can cause the open areas to be etched completely through the plate while the image containing areas are attaining the proper relief. Additionally, portions of the image adjacent to the open areas may be lost. Furthermore, excessive fuming occurs at higher concentrations of nitric acid.

Generally, a suitable range is from about 70 grams to about 360 grams of 420° Baume $HNO_3$ per liter of bath, while from about 140 grams to about 285 grams per liter is preferred. Herein, the amount of nitric acid is expressed in terms of 42° Baume $HNO_3$ merely for convenience: an equivalent amount of nitric acid introduced in other concentrations is also within the scope of the invention, and the teachings and claims which follow are to be interpreted accordingly.

While the amounts of the ingredients in the bath other than nitric acid remain essentially unchanged during use of the bath, the nitric acid is consumed as etching proceeds. To etch the maximum number of plates with a particular bath, therefore, it is desirable to fortify the bath periodically with additional nitric acid. In the usual practice of this invention, for example, after each etch run, i.e., wherein a single plate is etched or a plurality of plates are etched simultaneously, the partially depleted bath is fortified with from about 4 to about 9 grams of 42° Baume nitric acid per gram of magnesium dissolved in the bath during that particular run.

Sulfated Fatty Acid Ester

The sulfated fatty acid ester component is comprised of at least one sulfated ester of a fatty acid, and is selected from those esters which are mutually soluble or dispersible with the remaining bath ingredients when employed at concentrations and conditions suggested as preferred.

The fatty acid moiety of the ester, $$RC(=O)- \quad \text{in} \quad RC(=O)-OR',$$

is derived from fatty acids of from 10 to 24 carbon atoms which are unsaturated, or, which are saturated but have at least one hydroxyl group on their respective hydrocarbon chains at which position sulfation can occur. The term sulfated is used herein in the technically correct sense, i.e., denoting that the sulfur is not bonded directly to the carbon atom, but rather is bonded to an oxygen atom which is bonded to the carbon. Examples of suitable fatty acids, which, when esterified and sulfated, are suitable for use in this invention include oleic, ricinoleic, linoleic, palmitoleic, petroselinic, and vaccenic acids.

In the alcohol moiety of the ester, —OR′ in $$RC(=O)-OR',$$

′ contains from 1 to 12 carbon atoms, and R′ can be alkyl, cycloalkyl, saturated heterocyclyl having a preponderance of carbon atoms in the basic ring structure, or aryl, though alcohol moieties wherein R′ is alkyl are preferred. The terms "cycloalkyl" and "saturated heterocyclyl" as used herein are together intended to embrace not only the usual saturated carbocyclic radicals such as cyclobutyl, cyclopentyl, or cyclohexyl, but also saturated heterocyclic radicals such as, for example, pyrrolidinyl and tetrahydrofurfuryl.

Mixtures of a plurality of sulfated fatty acid esters having the characteristics just described are also benefically employed. Examples of commercial grade mixtures of such esters which have been found to be particularly useful include, for example, those marketed under the trademarks Emkafol OT brand of sulfated fatty esters and Surfax WO brand of sulfated propyl oleate, and particularly Calsolene Oil HSA brand of sulfated fatty acid ester.

While the sulfated fatty acid esters may be employed in concentrations ranging from about 0.25 grams to about 5 grams per liter of bath, the most satisfactory results have been obtained over a range from about 1 gram to about 3.5 grams per liter. These ranges are in terms of 100% activity; where a commercial product containing such an ester or a mixture of such esters containing a lesser percentage of the active ingredient is employed, those skilled in the art will of course compensate accordingly.

First Carboxylic Acid

The first carboxylic acid component is at least one saturated or olefinically unsaturated hydroxy-unsubstituted (i.e., non-hydroxylated) monocarboxylic acid of from 2 to 6 carbon atoms, or at least one polycarboxylic or hydroxy-substituted monocarboxylic acid of from 2 to 8 carbon atoms, or a mixture thereof. Acids meeting the requirements of the preceding sentence having in addition one or more non-hydroxy substituents such as, for example, halo or nitro are also acceptable, providing the substituent(s) do(es) not decrease the water solubility or dispersibility of the molecule to such an extent that it would no longer be soluble in the bath at the concentrations and conditions set forth herein as preferred. It has been found that saturated hydroxy monocarboxylic acids, e.g., glycolic and lactic acids; saturated dicarboxylic acids whether or not hydroxy substituted, e.g., adipic, malic, and tartaric acids; and saturated hydroxy tricarboxylic acids, e.g., citric acid, are preferable in that smaller quantities of such acids are required to achieve comparable results to those achieved with greater amounts of other acids. The saturated hydroxy di- and tricarboxylic acids are the most preferred, especially tartaric, malic, and citric acids.

While the specific optimum amount is readily determinable by those skilled in the art, within the range set forth above of from about 0.25 gram to about 6 grams per liter of bath, depending on the particular application and also on the quantities of the remaining ingredients employed, it is generally preferred to include from about 0.5 gram to about 2 grams of the first carboxylic acid per liter of bath.

Polyhydric Alcohol or Ether Derivative

The polyhydric alcohols or ether derivatives thereof may be saturated or olefinically unsaturated, and should be selected from those which are at least slightly soluble or dispersible in water, i.e., at least about 0.05 gram per liter of water. Although those which tend to be only slightly soluble are operable, those which are highly soluble are generally found to be preferable. Moreover, the hydrophobic portions preferably should be selected so as not to decrease substantially the water solubility or dispersibility of the molecule to such an extent that it would no longer be soluble in the bath at the concentrations and conditions set forth herein as preferred.

The polyhydric alcohols usable herein are preferably di- or trihydric but may contain more -OH groups (as in sorbitol). Alcohols of from 2 to 10 carbon atoms are preferred, particularly those having from 2 to 6 carbon atoms, and also those alcohols which are oxyalkylene or polyoxyalkylene glycols whose carbon chain is interrupted by one or more oxygen atoms, as in certain so-called ether glycols. Illustrative of operative alcohols under this invention are ethylene glycol, diethylene glycol, propylene glycol, triethylene glycol, hexylene glycol, di- and tripropylene glycol, glycerine, and the like.

Also embraced herein are ether derivatives of the aforementioned polyhydric alcohols, i.e., derivatives wherein one or more of the hydroxyl groups of the alcohols are replaced with an alkoxy or aryloxy group (—OR) where R is typically an alkyl or substituted alkyl radical of up to about 12 carbon atoms, but preferably from 1 to 8 carbon atoms, or where R is an aryl group. Examples of suitable polyhydric alcohol ethers include ethylene glycol n-butyl ether, triethylene glycol methyl ether, triethylene glycol butyl ether, and the alkylene glycol cycloalkyl ethers, alkylene glycol saturated heterocyclyl ethers, and alkylene glycol aryl ethers described in the next paragraph. Glycol ethers, as used herein denoting the ether derivatives of the polyhydric alcohols hereinbefore described in which at least one —OH function is etherified and at least one is not etherified, are in fact preferred for use herein, relative to the alcohols per se, and most preferred are ether derivatives in which the total number of carbon atoms per alkoxy group is from 1 to 4 for every internal oxygen atom interrupting the carbon chain of the alcohol. Thus, for example, a mono-ether derivative of diethylene glycol, the carbon chain of which is interrupted by one internal oxygen atom, preferably contains up to 4 carbon atoms in the alkoxy group:

$$R-O-C-C-O-C-C-OH$$

as in, e.g., diethylene glycol ethyl ether or diethylene glycol n-butyl ether. Diethylene glycol n-butyl ether has been found to give a particularly superior product.

The R group in the —OR moiety of the ether derivatives of the polyhydric alcohols contemplated herein may be alkyl, cycloalkyl, saturated heterocyclyl having a preponderance of carbon atoms in the basic ring structure, or aryl. (The meaning of the terms "cycloalkyl" and "saturated heterocyclyl" as contemplated herein is set forth in the foregoing description of the sulfated fatty acid ester component.) Suitable aromatic ethers include not only those wherein the R group of the —OR moiety is phenyl (as in, e.g., ethylene glycol phenyl ether) or naphthyl, but also those wherein the R group is a substituted aryl radical. Substituents on the aryl ring may be alkyl, alkoxy, halo, nitro, cyano, sulfo, and the like. The cycloalkyl and saturated heterocyclyl moieties contemplated herein may, of course, be similarly substituted with the substituents envisioned for the aryl moieties. Thus, compounds such as the monocyclobutyl ethers of ethylene glycol, diethylene glycol, triethylene glycol, propylene glycol, and butylene glycol are embraced herein. Generally, those ethers wherein the alkoxy, cycloalkoxy, or aryloxy moiety is relatively bulky are preferably ethers of polyoxyalkylene glycols, as opposed to ethers of polyhydric alcohols having no internal oxygen atom.

Generally, the amount of the polyhydric alcohol or ether in the final bath compositions will range from about 2 to about 25 grams per liter. While quantities of from about 3 grams to about 23 grams per liter are generally preferred, quantities from about 3 grams to about 10 grams per liter have been found to give superior results in the most preferred embodiments of this invention. It can readily be appreciated that optimum amounts will depend on many factors, including the particular compound selected, its molecular weight, and nature and quantity of the other components employed. The optimum amount for a particular application can be readily determined by those skilled in the art since dirty and incomplete etching will be observed in plates etched with a bath containing an insufficient quantity of the component, while an excess results in undercutting of the relief image.

Second Carboxylic Acid

The second saturated or olefinically unsaturated carboxylic acid comprises at least one hydroxy-unsubstituted monocarboxylic acid of from 8 to 24 carbon atoms. Generally, however, it is very much preferable to employ a blend of such acids, the preponderance of which comprises one or more acids having 18 carbon atoms, such as, for example, oleic acid. Furthermore, it has surprisingly been discovered that the use of saturated acids, rather than unsaturated acids or a mixture of saturated and unsaturated acids, results in a significantly more stable bath which will not deteriorate appreciably even if left standing for periods in excess of one week. For example, very stable baths producing excellent etch results have been obtained when isostearic acid comprises the preponderance of the second carboxylic acid.

When employing a preponderance of acids having 18 carbon atoms, it is particularly advantageous to include, per liter of bath, at least about 0.05 gram per liter of bath of one or more saturated hydroxy-unsubstituted monocarboxylic acids having from 8 to 12 carbon atoms, such as caprylic or capric acids, not to exceed a total of about one gram per liter of bath. A most preferred embodiment employs a blend of such shorter chain acids, wherein two or more of such acids each comprise at least about 20 weight percent of the blend, and together comprise at least about 85 weight percent of the blend. Emery 658 brand blend of 56% caprylic acid, 40% capric acid, 2% caproic acid and 2% lauric acid, as well as those blends of capric and caprylic acids sold under the trademarks Neo-Fat 360 and Hydrofol Acids 0856 have been found to be quite suitable for use in the invention contemplated herein.

The second carboxylic acid should be employed in quantities ranging from about 2 grams to about 15 grams per liter of bath, and preferably from about 5 grams to about 10 grams per liter of bath. A most preferred embodiment employs from about 5 grams to about 10 grams per liter of bath of an 18-carbon acid and from about 0.12 gram to about 0.15 gram per liter of bath of an 8- to 12-carbon fatty acid or blend thereof. As with each of the other ingredients, however, the above quantities are only approximations and may vary depending upon, for example, the nature and quantity of the other bath ingredients selected by one practicing the invention. While the longer chain fatty acids in combination with other bath components are employed to provide heavy filming protection against lateral etching, the shorter chain acids are particularly useful in selectively controlling the loss of the ends of lines in open areas such as are formed, for example, on plates prepared for printing business forms. Accordingly, one skilled in the art can readily arrive at an optimum quantity of the acid for the particular application.

Alkylarylsulfonate

The suitable alkylarylsulfonates, i.e., salts of the corresponding alkylarylsulfonic acid, are selected from the group consisting of the alkylbenzenesulfonates wherein the alkyl portion contains from 8 to 18 carbon atoms and the alkylnapthalenesulfonates wherein the alkyl portion contains from 3 to 18 carbon atoms, as exemplified in the formula $$RA - SO_3X$$

in which R is an alkyl radical having from 3 to 18 carbon atoms inclusive, A is an aromatic nucleus, such as phenyl or naphthyl, and X is hydrogen or a salt forming cation, e.g., an alkali metal or alkaline earth metal.

Typical of the alkylarylsulfonates that may be employed are sodium decylbenzenesulfonate, sodium dodecylbenzenesulfonate, sodium tetradecylbenzenesulfonate, sodium propylnaphthalenesulfonate, sodium amylnaphthalenesulfonate, sodium diamylnaphthalenesulfonate and sodium dodecylnaphthalenesulfonate. In the above illustrations, it will be understood that sodium can be replaced by, e.g., an amine to provide amine salts. The alkyl substituent or substituents are preferably such that the total number of carbon atoms in all the alkyl radicals taken together does not exceed about 14. The particular position of the alkyl radical on the aryl ring can also be varied. Thus, ortho alkylarylsulfonates, para alkylarylsulfonates, and meta alkylarylsulfonates are contemplated.

Examples of commercially available alkylarylsulfonates suitable for use in this invention include those marketed under the following trademarks: Bio Soft D-35, Bio Soft D-60, and Bio Soft D-62 brand of dodecylbenzenesulfonates; Emkal BNS butylnaphthalenesulfonate, Emkal NNS nonylnaphthalenesulfonate; Rueterg No. 40T, Rueterg No. 40U, and Rueterg No. 97S brand of alkylarylsulfonates; Sorbit P mixture of the sodium salts of mono- and di-butylnaphthalenesulfonates; and Wixol TC and Wixol BD brand of alkylarylsulfonates. While quantities ranging from about 0.25 gram to about 4 grams of the active alkylarylsulfonate ingredient per liter of bath have been found to be satisfactory, the best results have been obtained when using from about 0.5 to about 2 grams per liter of bath.

Additive

As was suggested above, it is convenient to prepare in advance an additive formulation, often referred to in the art as an "etch concentrate" or "mix", to which nitric acid and additional water are added to make up the hereinbefore described bath compositions. Such additive compositions can be transported per se as articles of commerce and constitute an embodiment of this invention separate from the ultimate etching bath composition.

It will be understood by those skilled in the art that it is advantageous to neutralize the acids in the additive formulation with an alkaline material such as sodium hydroxide so as to reduce the corrosiveness of the additive during shipment and storage. It will also be understood that additional minor ingredients such as foam suppressants may desirably be incorporated into either the additive or the ultimate bath composition in order to minimize foaming during the formulation, shipping, and handling of the additive composition and also during the actual etching process and eventual disposal of the spent bath.

An additive composition which has been found to be optimal has approximately the following composition of active components, based on the total weight of the additive:

| Ingredient | Weight Percent |
|---|---|
| Sulfated fatty acid ester(s) | 5.4 |
| First carboxylic acid(s) | 2.2 |
| Polyhydric alcohol(s) or ether(s) | 18 |

-continued

| Ingredient | Weight Percent |
|---|---|
| Second carboxylic acid(s) (Isostearic, 13%; Blend of 8–12 carbon acids, 0.3%) | 13.3 |
| Alkylarylsulfonate(s) | 2.7 |
| Caustic soda to neutralize to pH about 8, and water | Balance to 100 |

Satisfactory baths can also be prepared using additive formulations which contain the above components in proportions within about 10 percent of the weight percents set forth above. Thus, a useful additive may be comprised of from about 4.9 to about 6 weight percent sulfated fatty acid ester; from about 1.95 to about 2.45 weight percent first carboxylic acid; from about 16 to about 20 weight percent polyhydric alcohol or ether; from about 12 to about 14.6 weight percent second carboxylic acid; and from about 2.4 to about 3 weight percent alkylarylsulfonate. Similarly, the second carboxylic acid component preferably comprises an 18-carbon acid, such as, for example, isostearic acid, in an amount of from about 97.25 to about 98.25 weight percent, and an 8- to 12-carbon saturated acid, such as, for example, capric acid or caprylic acid, or a mixture thereof as hereinbefore described, in an amount of from about 1.75 to about 2.75 weight percent, based on the total weight of the second carboxylic acid component.

When a bath is made up from an additive mix, from about 30 grams to about 50 grams of the additive can be employed per liter of bath, but generally from about 35 grams to about 45 grams per liter is preferred. Of course, it will be recognized that the quantity of mix required will vary somewhat depending on the actual amount of water in the particular mix. The appropriate quantity of nitric acid to be used is set forth above in the description of the actual etching bath, and water is added to make up the desired volume of bath.

Process for Etching

In practicing the high speed etching of plates according to the present invention, a bath as hereinbefore described is prepared and maintained at a preselected temperature of preferably from about 100° F. to about 115° F. For purposes of the claims, "about 100° F." shall be construed as including temperatures at least as low as 98° F. The bath is operable at temperatures outside this range, but in doing so, either etch speed or safe working conditions must be compromised to some extent. Lower temperatures result in progressively slower etch rates. While faster etch rates can be obtained at somewhat higher temperatures, excessive fuming of the nitric acid component results, thereby rendering undesirable operation at temperatures much above the range indicated. It will be understood, of course, that the bath need not be maintained in the above temperature range during periods when it is not actually being used.

When mixed and adjusted to the preselected operating temperature, the bath is preferably impinged against the surface to be etched by a splashing action, although it is to be understood that any means of contacting the surface with the bath is within the scope of this invention. It is preferred to employ an etching machine of the type disclosed in U.S. Pat. No. 2,669,048, issued Feb. 16, 1954. In this machine, elongated paddles dipping into the bath composition intermittently throw, by splashing the etching bath composition in sheet upwardly against the image bearing side of the object being etched. Other etching machines designed for powderless etching are also applicable.

The following examples are given to further illustrate the present invention; they should be considered merely as being representative and not as limitations on the overall scope of the invention.

EXAMPLE 1

An etching bath consisting of the following ingredients was prepared in a 130-liter paddle-type powderless etching machine, and the temperature of the bath maintained in the range of from 108° F. to 110° F.:

| Ingredient | Grams Per Liter | Total Weight Grams |
|---|---|---|
| 42° Baume $HNO_3$ | 260 | 33,800 |
| Calsolene Oil HSA brand of sulfated fatty acid ester (45% activity) | 4.7 (2.1 g active) | 611 |
| Tartaric acid | 0.76 | 98.8 |
| Diethylene glycol n-butyl ether | 7.4 | 962 |
| Isostearic acid | 5.9 | 767 |
| Emery 658 brand blend of short chain saturated acids | 0.13 | 16.9 |
| Bio Soft D-60 brand of dodecylbenzene-sulfonate (60% activity) | 2 (1.2 g. active) | 260 |
| Water, to volume | | |

An image presensitized plate bearing a polyvinyl cinnamate based photoresist was descummed by scrubbing with a 5 percent aqueous nitric acid solution containing gum arabic. The plate was positioned in the etching machine. The machine was closed and the paddles adjusted to operate at a speed of 520 revolutions per minute (RPM). After four minutes of etching at such conditions, the machine was stopped and the plate removed and washed with an aqueous solution of ordinary household detergent and rinsed. The plate was etched to a depth of 0.032 inch. The quality of the etch was excellent, with no chipping or lateral etching being observed and closed portions of letters such as "A", "a", "B", "b", etc. being etched to a desirable depth.

EXAMPLES 2 THROUGH 9

Following procedures essentially similar to that described in Example 1, additional plates were etched using various bath compositions and etching conditions. The results obtained using a representaive sample of these baths under the conditions stated are summarized in Table I. In each instance, the particular plate described in each of Examples 2 through 9 was the first plate etched in the particular bath.

The various ingredients in Table I are identified as follows:

| Key | Trademark | Description |
|---|---|---|
| AA | — | adipic acid |
| B4 | Bio Soft D-40 | dodecylbenzenesulfonate (40%) |
| B6 | Bio Soft D-60 | dodecylbenzenesulfonate (60%) |
| CA | — | citric acid |
| CO | Calsolene Oil HSA | sulfated fatty acid ester (45%) |
| DB | — | diethylene glycol n-butyl ether |
| DE | Dowanol DE-SG | special grade of diethylene glycol ethyl ether |
| EB | Emkal BNS | butylnaphthalenesulfonate(33%) |
| EN | Emkal NNS | nonylnaphthalenesulfonate (33%) |
| EP | Dowanol EPh | ethylene glycol phenyl ether |
| IA | — | isostearic acid |
| LA | — | lactic acid |
| MA | — | malic acid |
| OA | — | oleic acid |
| RU | Rueterg No. 97-S | sodium dodecylbenzenesulfonate(88%) |
| SP | Sorbit P | mixture of sodium salts of mono- and di-butylnaphthylenesulfonates (65%) |
| SW | Surfax WO | sulfated propyl oleate (64%) |
| TA | — | tartaric acid |
| TB | Dowanol TBH | triethylene glycol butyl ether containing highers |
| WT | Wixol TC | alkylnaphthalenesulfonate (30%) |

TABLE I

COMPOSITION AND PERFORMANCE OF BATHS FOR EXAMPLES 2 THROUGH 9
All quantities are in grams per liter. Where components are identified by a tradename, correction has been made where the commercial product is less than 100% active; thus, all quantities shown are in terms of active ingredients

| Example No. | 42° Be. $HNO_3$ | Sulfated Ester(s) Key | Sulfated Ester(s) Quan. | First Carboxylic Acid Key | First Carboxylic Acid Quan. | Polyhydric Alcohol(s) or Ether(s) Key | Polyhydric Alcohol(s) or Ether(s) Quan. | Second Carboxylic Acid(s) Key | Second Carboxylic Acid(s) Quan. | Alkylaryl-Sulfonates Key | Alkylaryl-Sulfonates Quan. |
|---|---|---|---|---|---|---|---|---|---|---|---|
| 2 | 169 | CO | 3.3 | LA | 4.8 | DB | 5.6 | IA | 5.8 | B4 | 0.97 |
| 3 | 282 | CO | 1.35 | CA | 1.0 | TB | 5.0 | IA | 8.5 | SP | 1.4 |
| 4 | 282 | CO | 1.35 | AA | 2.0 | TB | 5.0 | IA | 8.5 | WT | 1.35 |
| 5 | 282 | CO | 1.35 | MA | 1.0 | EP | 8.0 | IA | 8.5 | WT | 1.35 |
| 6 | 240 | CO | 2.2 | MA | 0.81 | TB | 4.9 | IA | 3.21 | RU | 0.71 |
| | | | | | | TB | 4.6 | | | | |
| 7 | 232 | SW | 3.9 | MA | 1.85 | DE | 11.5 | OA | 6.9 | EN | 2.8 |
| | | | | | | TB | 4.6 | | | | |
| 8 | 240 | SW | 3.4 | MA | 1.38 | DE | 17.5 | OA | 7.7 | EB | 1.27 |
| 9 | 282 | SW | 2.9 | TA | 1.0 | DB | 7.4 | IA | 5.9 | B6 | 1.2 |

| Example No. | Run Time, Minutes | Bath Temperature ° F. | Paddle Speed RPM | 65 Line Screen Halftone Hi-lite Depth, Inch | Line Depth Inch | Comments |
|---|---|---|---|---|---|---|
| 2 | 3.0 | 110 | 500 | 0.009 | 0.022 | Fair to good plate (PVA resist) |
| 3 | 3.5 | 110 | 550 | 0.0075 | 0.028 | Fair to good; clean some shoulder irreg. |
| 4 | 3.5 | 110 | 550 | 0.009 | 0.031 | Good etch |
| 5 | 3.5 | 110 | 550 | 0.0085 | 0.030 | Good etch |
| 6 | 4.0 | 110 | 520 | 0.006 | 0.030 | Fair to good, usable |
| 7 | 5.0 | 98 | 415 | 0.005 | 0.028 | Good plate |
| 8 | 5.0 | 110 | 420 | 0.006 | 0.030 | Fair but usable; some shoulder irreg. |
| 9 | 4.0 | 104 | 500 | 0.008 | 0.028 | Good plate; clean |

EXAMPLE 10

A bath composition was formulated as follows in a 130-liter machine:

| Ingredient | Grams Per Liter |
|---|---|
| 42° Baume $HNO_3$ | 268 |

-continued

| Ingredient | Grams Per Liter |
|---|---|
| Calsolene Oil HSA brand of sulfated fatty acid ester (45% activity) | 4.9 (2.2 g active) |
| Tartaric acid | 0.893 |
| Diethylene glycol n-butyl ether | 7.35 |
| Isostearic acid | 5.3 |
| Emery 658 brand blend of short chain saturated acids | 0.122 |
| Bio Soft D-60 brand of dodecylbenzene-sulfonate (60% activity) | 1.84 (1.1 g. active) |
| Water, to volume | |

A number of plates were etched after each of which the bath was fortified with approximately 5.6 grams of 42° Baume nitric acid per gram of magnesium dissolved in the bath from such plate, until the bath contained a total of about 5510 grams (approximately 1.5 ounces per liter) of dissolved magnesium. Following replenishment of the bath with acid in the manner described, yet another plate was etched, and at a bath temperature of about 115° F. and a paddle speed of 480 RPM, an etch rate of 0.0015 inch per minute was obtained. Additional plates could have been etched using the same bath upon further fortification with an appropriate amount of additional nitric acid.

EXAMPLE 11

At the same temperature and paddle speed as in Example 10, an etch rate of 0.0025 inch per minute was realized using a bath containing about 5471 grams of magnesium and replenished with 7.0 grams of 42° Baume $HO_3$ per gram of dissolved magnesium. The bath used in this Example was initially formulated as follows:

| Ingredient | Grams per liter |
|---|---|
| 42° Baume $HNO_3$ | 268 |
| Calsolene Oil HSA brand of sulfated fatty acid ester (45% activity) | 6.13 (2.76 g. active) |
| Tartaric acid | 1.12 |
| Diethylene glycol n-butyl ether | 9.2 |
| Isostearic acid | 6.64 |
| Emery 658 brand blend of short chain saturated acids | 0.153 |
| Bio Soft D-60 brand of dodecylbenzenesulfonate (60% activity) | 2.3 (1.38 g. active) |
| Water, to volume | |

What is claimed is:

1. A process for powderless etching of photoengraving plates of magnesium or magnesium alloy which comprises:

a. preparing an etching bath which comprises water and, per liter of bath,

A. from about 70 grams to about 360 grams of 42° Baume nitric acid,

B. from about 0.25 gram to about 5 grams of a sulfated fatty acid ester having from 10 to 24 carbon atoms in the acid moiety and from 1 to 12 carbon atoms in the alcohol moiety, C. from about 0.25 gram to about 6 grams of a first saturated or olefinically unsaturated carboxylic acid which comprises a hydroxy-unsubstituted monocarboxylic acid of from 2 to 6 carbon atoms, or a polycarboxylic or hydroxy-substituted monocarboxylic acid of from 2 to 8 carbon atoms, D. from about 2 grams to about 25 grams of a polyhydric alcohol of from 2 to 10 carbon atoms or an ether derivative thereof, E. from about 2 grams to about 15 grams of a second saturated or olefinically unsaturated carboxylic acid which comprises at least one hydroxy-unsubstituted monocarboxylic acid having from 8 to 24 carbon atoms, and F. from about 0.25 gram to about 4 grams of an alkylarylsulfonate selected from the group consisting of the alkylbenzenesulfonates wherein the alkyl portion contains from 8 to 18 carbon atoms and the alkylnaphthalenesulfonates wherein the alkyl portion contains from 3 to 18 carbon atoms;

b. maintaining said bath at from about 100°F. to about 115°F; and c. contacting a plate bearing a photoresist coating image with a said bath until the uncoated portions of the plate have been etched to a satisfactory depth.

2. The etching process of claim 1 of preparing and maintaining a bath and contacting a plate with the bath wherein the bath is splashed against the plate.

3. The etching process of claim 2 of preparing, maintaining, and splashing the bath against a plate wherein:

a. the first saturated or olefinically unsaturated carboxylic acid is selected from the group consisting of hydroxy monocarboxylic acids, dicarboxylic acids, and hydroxy tricarboxylic acids;

b. the polyhydric alcohol or ether derivative thereof is a glycol ether; and c. the second saturated or olefinically unsaturated carboxylic acid consists of, per liter of bath, from about 2 grams to about 15 grams of at least one saturated or olefinically unsaturated hydroxy-unsubstituted monocarboxylic acid having 18 carbon atoms and from about 0.05 gram to about 1 gram of a blend of capric and caprylic acids.

4. The etching process of claim 2 of preparing, maintaining, and splashing the bath against a plate wherein:

a. the first saturated or olefinically unsaturated carboxylic acid is selected from the group consisting of hydroxy monocarboxylic acids, dicarboxylic acids, and hydroxy tricarboxylic acids;

b. the polyhydric alcohol or ether derivative thereof is a glycol ether; and c. the second saturated or olefinically unsaturated carboxylic acid consists of, per liter of bath, from about 2 grams to about 15 grams of at least one saturated acid having 18 carbon atoms and from about 0.05 gram to about 1 gram of a blend of capric and caprylic acids.

5. The etching process of claim 2 of preparing, maintaining, and splashing the bath against a plate wherein the bath comprises water and, per liter of bath:

a. from about 140 grams to about 285 grams of 42° Baume nitric acid;

b. from about 1 gram to about 3.5 grams of the sulfated fatty acid ester;

c. from about 0.5 grams to about 2 grams of the first saturated or olefinically unsaturated carboxylic acid;

d. from about 3 grams to about 10 grams of the polyhydric alcohol or ether derivative thereof;

e. from about 5 grams to about 10 grams of the second saturated or olefinically unsaturated carboxylic acid; and f. from about 0.5 grams to about 2 grams of the alkylarylsulfonate.

6. The etching process of claim 2 of preparing, maintaining, and splashing the bath against a plate wherein the bath comprises water and, per liter of bath:

a. from about 140 grams to about 285 grams of 42° Baume nitric acid;

b. from about 1 to about 3.5 grams of the sulfated fatty acid ester;

c. from about 0.5 to about 2 grams of tartaric acid;

d. from about 3 grams to about 10 grams of diethylene glycol n-butyl ether;

e. from about 5 grams to about 10 grams of isostearic acid;

f. from about 0.12 gram to about 0.15 gram of a blend of caprylic and capric acids; and g. from about 0.5 gram to about 2 grams of a dodecylbenzenesulfonate salt.

* * * * *

UNITED STATES PATENT OFFICE

CERTIFICATE OF CORRECTION

PATENT NO. : 3,992,234

DATED : Nov. 16, 1976

INVENTOR(S) : Marvin H. Fishaber, Philip C. White

It is certified that error appears in the above-identified patent and that said Letters Patent are hereby corrected as shown below:

Col. 2, line 10, delete "provided" and insert --provide--;
Col. 2, line 30, delete "used" and insert --use--;
Col. 3, line 59, delete "420°" and insert --42°--;
Col. 4, line 44, insert --R-- at beginning of line;
Col. 4, line 64, delete "grams" and insert --gram--;
Col. 10, line 19, insert --,-- after the word "splashing";
Col. 10, line 20, delete "sheet" and insert --sheets--;
Col. 10, line 62, after "and" insert the word --with--;
Col. 11, line 1, delete "representaive" and insert --representative--;
Col. 12, line 66, delete "$HO_3$" and insert --$HNO_3$--;
Col. 13, line 53, delete the word "a".

Signed and Sealed this

Nineteenth Day of April 1977

[SEAL]

*Attest:*

RUTH C. MASON
*Attesting Officer*

C. MARSHALL DANN
*Commissioner of Patents and Trademarks*